US009295134B2

(12) United States Patent
Van Der Burgt et al.

(10) Patent No.: US 9,295,134 B2
(45) Date of Patent: Mar. 22, 2016

(54) LIGHT SYSTEM FOR EMPHASIZING OBJECTS

(75) Inventors: Petrus Johannes Mathijs Van Der Burgt, Valkenswaard (NL); Stefan Marcus Verbrugh, Eindhoven (NL); Marcellinus Petrus Carolus Michael Krijn, Eindhoven (NL); Michel Cornelis Josephus Marie Vissenberg, Roermond (NL); Hao Hu, Beijing (CN); Oleg Belik, Eindhoven (NL); Robert-Paul Mario Berretty, Utrecht (NL); Lodewijk Daniella Stanslaw Hendriks, Helmond (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 699 days.

(21) Appl. No.: 13/514,236

(22) PCT Filed: Nov. 24, 2010

(86) PCT No.: PCT/IB2010/055394

§ 371 (c)(1),
(2), (4) Date: Sep. 9, 2012

(87) PCT Pub. No.: WO2011/070473

PCT Pub. Date: Jun. 16, 2011

(65) Prior Publication Data

US 2013/0169796 A1 Jul. 4, 2013

(30) Foreign Application Priority Data

Dec. 9, 2009 (EP) ..... 09178483

(51) Int. Cl.
*H05B 37/02* (2006.01)
*H05B 33/08* (2006.01)

(52) U.S. Cl.
CPC ..... *H05B 37/02* (2013.01); *H05B 33/0866* (2013.01); *H05B 37/029* (2013.01)

(58) Field of Classification Search
CPC ... H05B 33/0866; H05B 37/02; H05B 37/029
See application file for complete search history.

(56) References Cited

U.S. PATENT DOCUMENTS 5,495,429 A 2/1996 Craven
5,969,754 A * 10/1999 Zeman ..... 348/136

(Continued)

FOREIGN PATENT DOCUMENTS

CN 101029985 A 9/2007
CN 101489051 A 7/2009

(Continued)

OTHER PUBLICATIONS

Wenger, A. et al "Optimizing Color Matching in a Lighting Reproduction System for Complex Subject and Illuminant Spectra" Eurographics Symposium on Rendering 2003, University of Southern California Institute for Creative Technologies, pp. 1-12.

*Primary Examiner* — Jefferey Harold
*Assistant Examiner* — Sean Haiem
(74) *Attorney, Agent, or Firm* — Meenakshy Chakravorty

(57) ABSTRACT

Light-emitting devices (100) and methods for operating light-emitting devices are disclosed. Each of the light-emitting devices (100) comprises a plurality of light sources (112A-112F) for illuminating a target (120), wherein each of the light sources is configured to emit light within a predetermined color range. Each of the light-emitting devices comprises means (140) for automatically adjusting the spectral power distribution of light-emitted by the light-emitting device on basis of the color of the target or a region of the target illuminated by the light-emitting device, such that light emitted by the light-emitting device is made increasingly compliant or even compliant with a criteria of a predetermined color characteristics.

15 Claims, 8 Drawing Sheets

(56) References Cited

U.S. PATENT DOCUMENTS

| | | | | |
|---|---|---|---|---|
| 6,072,281 | A * | 6/2000 | Ogawa | 315/241 P |
| 7,262,853 | B2 | 8/2007 | Peterson | |
| 2004/0211888 | A1 * | 10/2004 | Shur et al. | 250/221 |
| 2006/0012987 | A9 * | 1/2006 | Ducharme et al. | 362/231 |

FOREIGN PATENT DOCUMENTS

| | | | |
|---|---|---|---|
| JP | 10335071 | A | 12/1998 |
| JP | 2001250696 | A | 9/2001 |
| WO | 9826583 | A1 | 6/1998 |
| WO | 2009076771 | A1 | 6/2009 |

* cited by examiner

LIGHT SYSTEM FOR EMPHASIZING OBJECTS

FIELD OF THE INVENTION

The present invention is generally related to the field of lighting. In particular, the present invention is related to light-emitting devices and methods for operating light-emitting devices comprising a plurality of light sources for illuminating a target, each of the light sources being configured to emit light within a predetermined color range.

BACKGROUND OF THE INVENTION

Light is composed of electromagnetic waves having various wavelengths within a wavelength range of about 400 nm to about 700 nm. Each electromagnetic wave having a wavelength within this range produces light exhibiting a distinct color of light, from deep blue/purple at a wavelength of about 400 nm to deep red at a wavelength of about 700 nm. By "mixing" electromagnetic waves having different wavelengths light exhibiting various colors can be produced.

Light-emitting devices comprising a number of light sources, each light source being capable of emitting light that in general has a different color compared to the other light sources, may be utilized to provide light having a variety of colors. For example, a light-emitting diode (LED) device comprising three LEDs emitting light in different wavelength ranges (i.e. exhibiting different colors) can be utilized to provide light having virtually any color point within the triangle in a color space, for example in a chromaticity diagram, defined by three color points of the respective LEDs. By adjusting the light flux levels of the LEDs (i.e. currents through the respective LEDs) relatively to each other appropriately, there can be achieved light emitted from the LED device having different color points and/or light spectra.

For controlling the color of emitted light, conventional light-emitting devices are in general provided with a controller having a user interface that may enable a user to adjust the color of light emitted by the light-emitting device. Such user interfaces may be relatively complicated and/or non-intuitive for the user such that operation of the light-emitting device becomes relatively awkward and/or difficult. Furthermore, once the user has selected a color point of the emitted light by means of user input via the user interface, the user in general has to make a judgment as of whether the lighting atmosphere that is created by means of the selected setting is appropriate in view of the type and/or nature of the objects and/or persons that are illuminated by the light-emitting device. Thus, once the user has adjusted the settings of the light-emitting device such as to select the color point of the light emitted by the light-emitting device, the user has to determine whether the selected settings are appropriate in view of the lighting application on a 'what-you-see-is-what-you-get' basis.

SUMMARY OF THE INVENTION

It is with respect to the above considerations and others that the present invention has been made. The present invention seeks to mitigate, alleviate or eliminate one or more of the above-mentioned deficiencies and disadvantages singly or in combination. In particular, the inventors have realized that it would be desirable to achieve a light-emitting device capable of emitting light having in principle any color point. The inventors have further realized that it would be desirable to achieve a light-emitting device wherein the color point and/or the spectral power distribution of light emitted by the light-emitting device can be controlled with relatively little or even without user input at all, i.e. controlled substantially automatically by the light-emitting device. This means that parameters such as color temperature, chromaticity and/or color rendering can be controlled with relatively little or even without user input at all, i.e. controlled substantially automatically by the light-emitting device, so as to adapt the lighting atmosphere that is created by the light emitted by the light-emitting device to the type and/or nature of the objects and/or persons that are illuminated by the light-emitting device. By control of the color point of the light emitted by the light-emitting device, the present invention may enable enhancing or suppressing the visual appearance of an object or objects illuminated by the light-emitting device, as perceived by a viewer.

To better address one or more of these concerns, methods and light-emitting devices having the features as defined in the independent claims are provided. Further advantageous embodiments of the present invention are defined in the dependent claims.

According to a first aspect of the present invention, there is provided a light-emitting device comprising a plurality of light sources for illuminating a target. Each of the light sources is configured to emit light within a predetermined color range. The light-emitting device comprises at least one photo detector adapted to receive light reflected at an illuminated region of the target. The light-emitting device comprises a processing module adapted to process signals generated by the at least one photo detector such as to determine a dominant color of the illuminated region of the target. On basis of the dominant color and a criteria of a predetermined color characteristics of light emitted by the light-emitting device, the processing module is adapted to generate at least one setting for the intensities of the plurality of light sources relatively to each other such that, when the at least one setting is applied to the plurality of light sources, light emitted by the light-emitting device is made increasingly compliant or even compliant with the criteria of the predetermined color characteristics.

Such a configuration may provide a light-emitting device wherein the color point and/or the spectral power distribution of light emitted by the light-emitting device can be controlled with relatively little or even without user input at all. In other words, the color point and/or the spectral power distribution of light emitted by the light-emitting device may be controlled substantially automatically by the light-emitting device. In turn, this may enable control of various lighting parameters such as color temperature, color point (chromaticity) and/or color rendering with relatively little or even without user input at all. In other words, control of various lighting parameters such as color temperature, chromaticity and/or color rendering may be performed by the light-emitting device substantially automatically so as to adapt the lighting atmosphere that is created by the light emitted by the light-emitting device to the type and/or nature of the objects and/or persons that are illuminated by the light-emitting device.

As already indicated in the foregoing, the light-emitting device may enable control of the spectral power distribution of light emitted by the light-emitting device with little or no user intervention. In other words, no user interface may be required while enabling control of the spectral power distribution of light emitted by the light-emitting device. Such an arrangement may be advantageous in some applications, especially for applications in retail. Retailers are in general reluctant in introducing control devices for controlling lighting for illuminating merchandise or articles. Also in other applications, such as theatrical applications, in museums, art galleries etc. automatic control of the spectral power distribution of light emitted by the light-emitting device may be advantageous.

The spectral power distribution of light emitted by the light-emitting device may for example be adjusted or set such that one or more predetermined colors of an illuminated object are visually emphasized or deemphasized as perceived by the viewer/user, or such that the light emitted by the light-emitting device obtains a color temperature that suits the object or objects being illuminated. For example, a warmer (i.e., lower color temperature) light may be used in public areas for promoting relaxation, while a cooler (higher color temperature) light may be used to enhance work performance of the staff in office spaces.

As described in the foregoing, the at least one setting for the intensities of the plurality of light sources relatively to each other (resulting in the desired color point and/or spectral power distribution of the emitted light) is generated on basis of a dominant color of the illuminated region of the target and a criteria of a predetermined color characteristics of light emitted by the light-emitting device. As indicated in the foregoing, the predetermined color characteristics may thus comprise the color temperature of the color of emitted light. Alternatively or optionally, the predetermined color characteristics may among other things comprise color rendering of the light-emitting device and chromaticity of the color of emitted light.

The choice of predetermined color characteristics may be selected at the moment the light-emitting device is installed, for example by setting a dip switch or the like in circuitry comprised in the light-emitting device, the dip switch being operative to select the predetermined color characteristics. Alternatively or optionally, a programmable chip may be employed for enabling selecting the choice of predetermined color characteristics. Alternatively or optionally, the choice of predetermined color characteristics may be performed dynamically, i.e. during operation of the light-emitting device, thus enabling adapting to different illumination conditions and/or desired lighting effects resulting from the emitted light.

Thus, the spectral power distribution of the light-emitting device may be achieved by adjusting the intensities of the plurality of light sources relatively each other based on a previously selected, predetermined color characteristics of the light-emitting device, i.e. a parameter characterizing the light output from the light-emitting device. This parameter can be selected for example so as to visually emphasize a certain color on the target or so as to achieve a relatively faithful color rendition of the target as perceived by a viewer.

For example, by means of a light-emitting device comprising a plurality of light sources, each light source emitting light within a distinct portion of the spectrum of light, white or substantially white light with a specified color point can be created and the spectral power distribution can be chosen (as the specified color point can be set in several ways by adjusting the intensities of the plurality of light sources relatively each other) so as to visually emphasize different colors on the target.

In other words, by adjusting the spectral power distribution of light emitted by the light-emitting device on basis of the color of the target or a region of the target illuminated by the light-emitting device, such that light emitted by the light-emitting device is made increasingly compliant or even compliant with a criteria of a predetermined color characteristics, in turn a criteria of a color characteristics of the illuminated target can be achieved.

As described in the foregoing, the generated at least one setting of the intensities of the plurality of light sources relatively to each other is configured such that when the at least one setting is applied to the plurality of light sources light emitted by the light-emitting device is made increasingly compliant or even compliant with the criteria of the predetermined color characteristics. In other words, when the at least one setting is applied to the plurality of light sources, the light-emitting device may be 'optimized' with respect to the predetermined color characteristics. Thus, once the at least one setting is applied to the plurality of light sources, light emitted by the light-emitting device may or may not fulfill the criteria of the predetermined color characteristics while still having been made increasingly compliant or even compliant with it, i.e. in general conform with the criteria to a larger extent compared to when another setting of the intensities of the plurality of light sources relatively to each other is applied to the plurality of light sources.

According to a second aspect of the present invention, there is provided a light-emitting device comprising a plurality of light sources for illuminating a target. Each of the light sources is configured to emit light within a predetermined color range. The light-emitting device comprises an image capturing module adapted to capture at least one image comprising an illuminated region of the target and an object having a predetermined shape, the object being disposed between the illuminated region of the target and the light-emitting device such that the object at least partially overlaps the illuminated region in the image. The image capturing module comprises an image sensor adapted to produce an image representation of each captured image. The light-emitting device comprises a memory module. The light-emitting device comprises a processing module adapted to process the image representation such as to compare the predetermined shape of the object with at least one shape stored in the memory module. The processing module is adapted to, on a condition that the predetermined shape matches a shape stored in the memory module, process the image representation such as to determine a color of a portion of the illuminated region of the target bordering the object in the image representation. The processing module is adapted to, on basis of the determined color and a criteria of a predetermined color characteristics of light emitted by the light-emitting device, generate at least one setting of the intensities of the plurality of light sources relatively to each other such that, when the at least one setting is applied to the plurality of light sources, light emitted by the light-emitting device is made increasingly compliant or even compliant with the criteria of the predetermined color characteristics.

Such a configuration may enable achieving some or all of the advantages achieved by means of the light-emitting device according to the first aspect of the present invention. In addition, a configuration according to the second aspect of the present invention may be advantageous in case a color of the target desired to visually emphasize or deemphasize is difficult to detect automatically as described in the foregoing. For example, in case the target is relatively small and/or situated at a relatively long distance from the light-emitting device, the color of the target in the image representation of a captured image may not be the dominant color in the image representation. In such a case a light-emitting device according to the second aspect of the present invention may enable a user to hold a certain object or pointer device in front of the target or the region of the target whose color is desired to emphasize for a predetermined duration, wherein the light-emitting device may automatically compare the shape of the object with stored object shapes in order to recognize the object as a pointer device by the shape of the pointer device, and subsequently, if the object is recognized as a pointer device, the light-emitting device may determine a color of a portion of the illuminated region of the target bordering the object (pointer device) in the image representation. The determined color is then used in generating at least one setting of the intensities of the plurality of light sources relatively to each other such as described in the foregoing. Thus, the object having the predetermined shape may function as a pointer device for pointing out to the light-emitting device the target or the region of the target whose color is to be determined.

Thus, both of the first and the second aspect of the present invention provides a means for achieving a light-emitting device capable of automatically adjusting the spectral power distribution of light emitted by the light-emitting device on basis of the color of the target or a region of the target illuminated by the light-emitting device, such that light emitted by the light-emitting device is made increasingly compliant or even compliant with a criteria of a predetermined color characteristics. The above mentioned color is determined either as a dominant color of the illuminated region of the target by processing signals generated by the at least one photo detector adapted to receive light reflected at an illuminated region of the target (according to the first aspect of the present invention) or as the color of a portion of the illuminated region of the target bordering an object having a predetermined shape (pointer device) recognized by the light-emitting device in the image representation.

According to a third aspect of the present invention, there is provided a method of operating a light-emitting device comprising a plurality of light sources, each of the light sources being configured to emit light within a predetermined color range, wherein at least one photo detector receives light reflected at an illuminated region of the target. Signals generated by the at least one photo detector are processed such as to determine a dominant color of the illuminated region of the target. On basis of the dominant color and a criteria of a predetermined color characteristics of light emitted by the light-emitting device, at least one setting for the intensities of the plurality of light sources relatively to each other is generated such that, when the at least one setting is applied to the plurality of light sources, light emitted by the light-emitting device is made increasingly compliant or even compliant with the criteria of the predetermined color characteristics. The generated at least one setting is applied to the plurality of light sources.

By a method according to the third aspect of the present invention there may be achieved the same or similar advantages as the advantages achieved by the light-emitting device according to the first aspect of the present invention.

According to a fourth aspect of the present invention, there is provided a method of operating a light-emitting device comprising a plurality of light sources, each of the light sources being configured to emit light within a predetermined color range. The method comprises capturing at least one image comprising an illuminated region of the target and an object having a predetermined shape and producing an image representation of each captured image, wherein the object is disposed between the illuminated region of the target and the light-emitting device such that the object at least partially overlaps the illuminated region in the image. The predetermined shape of the object is compared with at least one stored shape. On a condition that the predetermined shape matches a stored shape, the image representation is processed such as to determine a color of a portion of the illuminated region of the target bordering the object in the image representation. On basis of the determined color and a criteria of a predetermined color characteristics of light emitted by the light-emitting device, at least one setting for the intensities of the plurality of light sources relatively to each other is generated such that, when the at least one setting is applied to the plurality of light sources, light emitted by the light-emitting device is made increasingly compliant or even compliant with the criteria of the predetermined color characteristics. The method comprises applying the generated at least one setting to the plurality of light sources.

By a method according to the fourth aspect of the present invention there may be achieved the same or similar advantages as the advantages achieved by the light-emitting device according to the second aspect of the present invention.

According to a fifth aspect of the present invention, there is provided a computer program product adapted to, when executed in a processor unit, perform a method according to the third or fourth aspect of the present invention or any embodiment thereof.

According to a sixth aspect of the present invention, there is provided a computer-readable storage medium on which there is stored a computer program product adapted to, when executed in a processor unit, perform a method according to the third or fourth aspect of the present invention or any embodiment thereof.

According to a seventh aspect of the present invention, there is provided a luminaire comprising a light-emitting device according to the first or second aspect of the present invention or any embodiment thereof.

The light-emitting device may comprise an optical assembly adapted to project an illuminated region of the target onto the at least one photo detector.

Alternatively or optionally, the at least one photo detector may be directed such that the beam of light emitted by the light-emitting device substantially coincides with the beam of light impinging on the at least one photo detector.

The spectral sensitivity of the at least one photo detector may for example encompass at least three distinct wavelength regions (for example at least the blue, green and red portion of the spectrum of light).

The at least one photo detector may for example be comprised in an image sensor comprised in an image capturing module. In other words, the light-emitting device may comprise an image capturing module being arranged with the at least one photo detector. The image capturing module is adapted to capture at least one image comprising an illuminated region of the target, wherein the image sensor is adapted to produce an image representation of each captured image, and wherein the processing module is adapted to process the image representation such as to determine a dominant color of the illuminated region of the target in the image representation.

The spectral sensitivity of the image sensor may for example encompass at least three distinct wavelength regions (for example at least the blue, green and red portion of the spectrum of light).

The dominant color may for example be a color that is the or one of the most abundant in the field of view associated with the image sensor (i.e. a color that is to a larger extent present in the image representation compared to other colors present in the image representation) for example when the light-emitting device is adapted such as to emit substantially white light. The dominant color may be the average color of the colors appearing in the field of view associated with the image sensor, i.e. the average color of the image representation. The dominant color in the image representation may be determined in alternate or optional manners. This is further described in the following.

As already indicated in the foregoing, the image capturing module is adapted to image at least an illuminated region of the target being illuminated such that color information of the illuminated region can be deduced from an image representation of each captured image produced by the image sensor. In the context of some embodiments of the present invention, by "image" or "captured image" it may not necessarily be referred an optical image but it may refer to a set of values indicative of the color of light impinging on different locations on the image sensor. In other words, the image sensor may be adapted to detect the color(s) of the illuminated region of the target being illuminated.

The image sensor, being adapted to produce an image representation of each captured image, may for example comprise a camera and/or a color sensor or the like. The color sensor may for example comprise or be constituted by one or more photo detectors such as photodiodes or photo resistors and one or more respective color filters, a charge-coupled device (CCD) and/or a complementary metal-oxide-semiconductor active pixel sensor and a respective color filter array.

The image capturing module may comprise an optical assembly adapted to project an image onto the image sensor, the image for example comprising an illuminated region of the target. This may be especially advantageous in case the image sensor is constituted by a single color sensor element (for example a "camera" comprising a single pixel).

Alternatively or optionally, the image capturing module may be directed such that the beam of light emitted by the light-emitting device substantially coincides with the beam of light impinging on the image sensor.

The at least one setting of the intensities of the plurality of light sources relatively to each other may be generated under the constraint of keeping the intensity of any light source emitting light within a color range in which the determined color, which may be a dominant color in the image representation, is included constant and/or different from zero.

In other words, one or more of the light sources may be selected, for example by user input via a user interface, whose intensity or intensities are fixed at some value, and the processing module may then generate the at least one setting of the intensities of the plurality of light sources relatively to each other while keeping the intensity or intensities of the selected one or more light sources at the fixed value.

Such a configuration may enable to increasingly visually emphasize or highlight the target or a region of the target having a certain color, the target or the region of the target being illuminated by light from the light-emitting device. This is further described with reference to the following example.

According to one example, the light-emitting device has been adapted such that the light-emitting device emits light having a color point that is close to the black body locus (BBL), such that light having a light color or a substantially white color is used for illuminating the target or a region of the target. The target or the region of the target has a certain color that in general is different from the color of the light illuminating the target or the region of the target. The intensity of a selected light source, emitting light having a color point close or equal to the color point of the color of the target or the region of the target, may be kept at a fixed value while generating the at least one setting of the intensities of the light sources relatively to each other. In other words, the at least one setting may be generated such that the light of the light-emitting device is a mixture of light having different color points, wherein the mixture of light includes a proportion of light having a color point close to or equal to the color point of the color of the target or the region of the target (for example, white light used for illuminating the target or the region of the target, which has a red color, is mixed with a proportion of light having a color point close to or equal to red). As a result, the resulting mixture of light may increasingly visually emphasize or highlight the target or the region of the target.

In the context of some embodiments of the present invention, by the BBL (also known as Planckian locus, or white line) it is meant the path or locus that the color of an incandescent black body would take in a particular chromaticity space (e.g., in a chromaticity diagram) as the temperature of the black body changes.

The at least one setting of the intensities of the plurality of light sources may be generated such that the at least one setting, when applied to the plurality of light sources, results in that light emitted from the light-emitting device exhibits the determined color, which may be a dominant color.

In this manner there may be provided automatic control of the color point of light emitted by the light-emitting device on basis of the determined color.

The light-emitting device may comprise a memory module adapted to store the at least one setting of the intensities of the plurality of light sources. One or more of the at least one setting stored in the memory module may be retrieved.

The one or more retrieved settings stored in the memory module may then be applied to the plurality of light sources.

Such a configuration enables storing presets of the setting of the intensities of the plurality of light sources, which presets can be recalled at a later time when required.

For the purpose of applying the generated at least one setting or a setting retrieved from the memory unit to the plurality of light sources the light-emitting device may comprise a control module operative for this purpose. The control module may for example be programmed such as to apply different settings of the intensities of the plurality of light sources at different points in time. In other words, the control module may operate as a driver for the plurality of light sources. For example, the different settings may be configured such that each of the different settings, when applied to the plurality of light sources, results in that light emitted by the light-emitting device exhibits the same color point. In this manner, light having the same color point, but providing different lighting atmospheres, may be provided at different points in time, for example for visually indicating targets or regions of a target having different colors, as described in the foregoing.

The light-emitting device may comprise a light-emitting pointing device, wherein at least a portion of the light reflected at an illuminated region of the target received by the at least one photo detector has been emitted by the light-emitting pointing device.

Such a configuration may enable pointing out, for example by a user operating the light-emitting pointing device, a portion or even the whole of the illuminated region of the target, and subsequently determine a dominant color of the portion or even the whole of the illuminated region. The light-emitting pointing device may be adapted such that the beam of light emitted by the light-emitting pointing device is adjustable, for example with regards to width of the beam. To point out the particular spot or region of the target, of which a dominant color is to be determined, may be advantageous in case a color (e.g. of a spot) of the target desired to visually emphasize or deemphasize is difficult to detect automatically as described in the foregoing, for example in case the target is relatively small and/or situated at a relatively long distance from the light-emitting device as described in the foregoing.

The light-emitting device may comprise a number of light-emitting pointing devices.

The light-emitting device may comprise a light modulation unit configured to modulate light emitted by the plurality of light sources, or to modulate light emitted by the light-emitting pointing device, and detect modulation of light impinging onto the at least one photo detector.

The detection of modulation of light impinging onto the at least one photo detector may be performed prior to the light impinging onto the at least one photo detector.

Such a configuration may enable avoiding so called 'cross talk' between light emitted by the plurality of light sources and light emitted by the light-emitting pointing device. In other words, by such a configuration light emitted by the light-emitting pointing device (or light emitted by the plurality of light source) can be modulated (in other words, 'coded') which in turn may enable determining at the at least one photo detector (by means of the light modulation unit detecting whether the light impinging on the at least one photo detector is modulated or not modulated) whether light reflected from the illuminated target or region of the target originates from the light-emitting pointing device or from the plurality of light sources. For example, if light emitted by the light-emitting pointing device is modulated according to a predetermined light modulation scheme, while light emitted by the plurality of light sources is not modulated, and modulated light from the light-emitting pointing device subsequently being reflected at a portion of the illuminated target, the at least one photo detector may be able to distinguish between light impinging on the at least one photo detector originating from the plurality of light sources and light impinging on the at least one photo detector originating from the light-emitting pointing device.

The plurality of light sources preferably comprises a plurality of solid-state light sources, such as light-emitting diodes (LEDs). Such LEDs may be inorganic or organic. The plurality of light sources may alternatively or optionally comprise one or more color fluorescence lamps (CFL).

The steps of any method disclosed herein do not have to be performed in the exact order disclosed, unless explicitly stated.

The present invention relates to all possible combinations of features recited in the claims.

Further objects and advantages of the various embodiments of the present invention will be described below by means of exemplifying embodiments.

BRIEF DESCRIPTION OF THE DRAWINGS

Exemplifying embodiments of the invention will be described below with reference to the accompanying drawings, in which.

In the accompanying drawings, the same reference numerals denote the same or similar elements throughout the views.

DETAILED DESCRIPTION

The present invention will now be described more fully hereinafter with reference to the accompanying drawings, in which exemplifying embodiments of the invention are shown. This invention may, however, be embodied in many different forms and should not be construed as limited to the embodiments set forth herein; rather, these embodiments are provided by way of example so that this disclosure will convey the scope of the invention to those skilled in the art. Furthermore, like numbers refer to like or similar elements throughout.

Figure 1A:
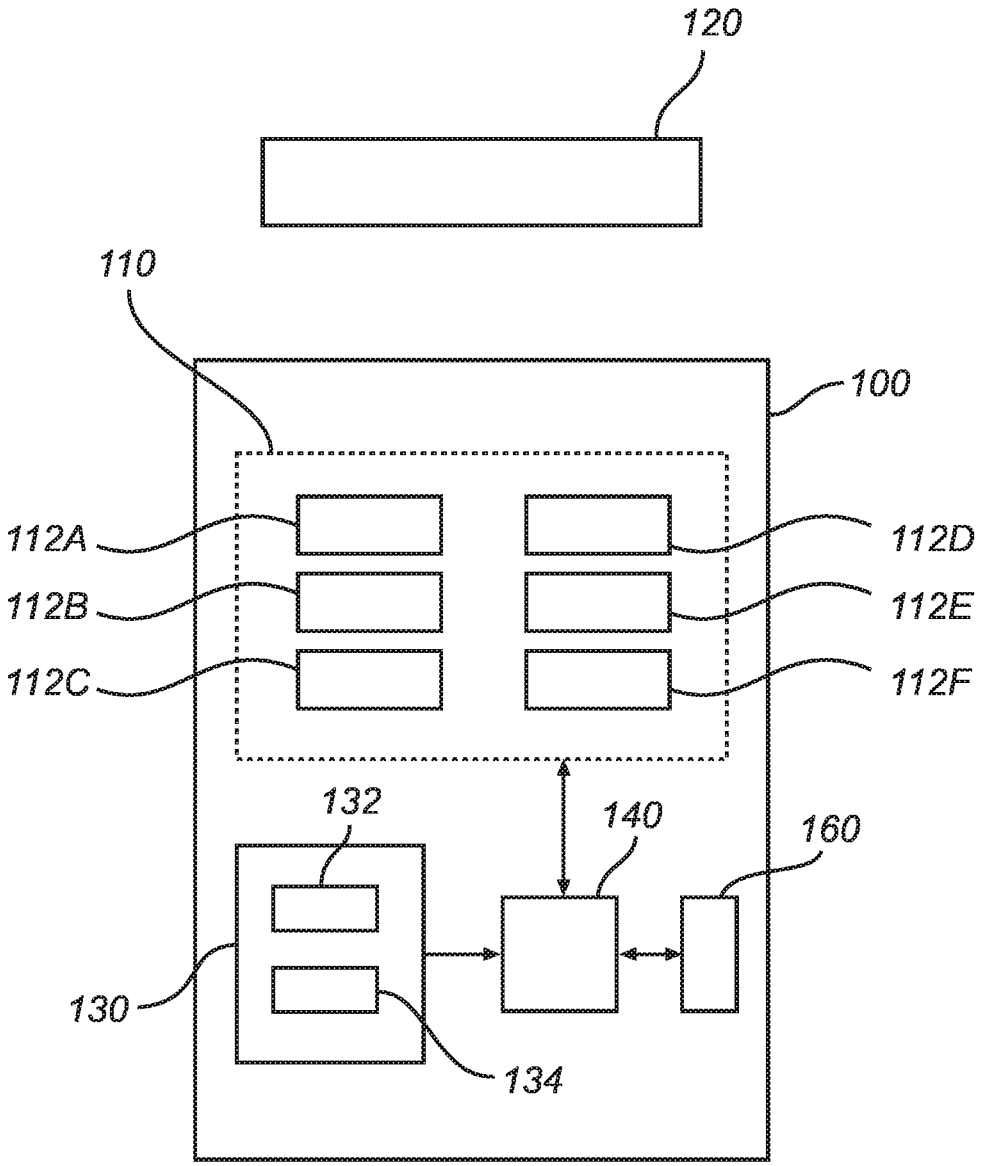
FIG. 1A is a schematic block diagram of a light-emitting device according to an exemplifying embodiment of the present invention.

Referring now to FIG. 1A, there is shown a schematic block diagram of a light-emitting device 100 according to an exemplifying embodiment of the present invention. The light-emitting device 100 comprises a plurality 110 of light sources 112A, 112B, . . . , 112F for illuminating a target 120. Each of the light sources 112A, 112B, . . . , 112F is configured to emit light within a predetermined color range. The light-emitting device 100 comprises an image capturing module 130 adapted to capture at least one image comprising an illuminated region of the target 120. The image capturing module 130 comprises an image sensor 132 adapted to produce an image representation of each captured image. A processing module 140 is adapted to process each image representation for the purpose of determining a dominant color in the image representation. On basis of the determined dominant color and a criteria of a predetermined color characteristics of light emitted by the light-emitting device 100, the processing module 140 is adapted to generate at least one setting of the intensities of the plurality 110 of light sources 112A, 112B, . . . , 112F relatively to each other, the at least one setting configured such that, when applied to the plurality 110 of light sources 112A, 112B, . . . , 112F, light emitted by the light-emitting device 100 is made increasingly compliant or even compliant with the criteria of the predetermined color characteristics.

The image capturing module 130 comprises an optical assembly 134 adapted to project the image comprising the illuminated region of the target 120 onto the image sensor 132.

The optical assembly 134 is optional: an arrangement wherein light impinges directly onto the image sensor 132 is within the scope of the present invention.

With further reference to FIG. 1A, the light-emitting device 100 comprises a memory module 160 adapted to store the at least one setting of the intensities of the plurality 110 of light sources 112A, 112B, . . . , 112F. One or more of the at least one setting stored in the memory module 160 may be retrieved, e.g. by the processing unit 140 or a control module (not shown in FIG. 1A, see FIG. 2) and subsequently applied to the plurality 110 of light sources 112A, 112B, . . . , 112F.

Thus, presets of the setting of the intensities of the plurality 110 of light sources 112A, 112B, . . . , 112F may be stored in the memory module 160, which presets can be recalled at a later time when required.

Although the number of light sources 112A, 112B, . . . , 112F of the embodiments depicted in the appended drawings is six, the present invention is not limited to this number but the light-emitting device 100 may in principle comprise any number of light sources 112A, 112B, . . . , 112F. According to one example the light-emitting device 100 comprises at least three light sources, each light source emitting light within a distinct portion of the spectrum of light, for conforming to an RGB color model.

The image sensor 132 may for example comprise a charge-coupled device (CCD). CCDs are known in the art, and thus the operation of CCDs is merely described briefly in the following. A CCD-based image capturing module or device typically includes an aperture (not shown in FIG. 1A) through which light from the image being captured is transmitted and sensed by the CCD. A CCD generally comprises at least one sensor element (not shown in FIG. 1A). Each sensor element of the CCD senses the intensity of the light which impinges upon the sensor element. The value of the intensity sensed by each sensor element may be stored in a memory or the like for subsequent image processing. The intensities that are sensed by the sensor elements of the CCD correspond to gray scale values for a black and white image. For achieving color sensing capabilities, a CCD-based image capturing module may comprise a color filter array (CFA) or a color separation mechanism (not shown in FIG. 1A) that may be interposed between the aperture of the CCD-based image capturing module and the CCD. The CFA may for example be constituted by at least one color filter element (not shown in FIG. 1A) in a one to one correspondence with the sensor element(s) of the CCD. Each filter element generally enables only light having a wavelength within a distinct wavelength range to pass through the filter element. This light may then impinge on a sensor element of the CCD, which sensor element senses the intensity of the colored light on the sensor element. As each sensor element of the CCD corresponds to a color filter element, the data derived from a sensor element of the CCD comprises an intensity value and an indication of the color of the light impinging on the sensor element.

Figure 1B:
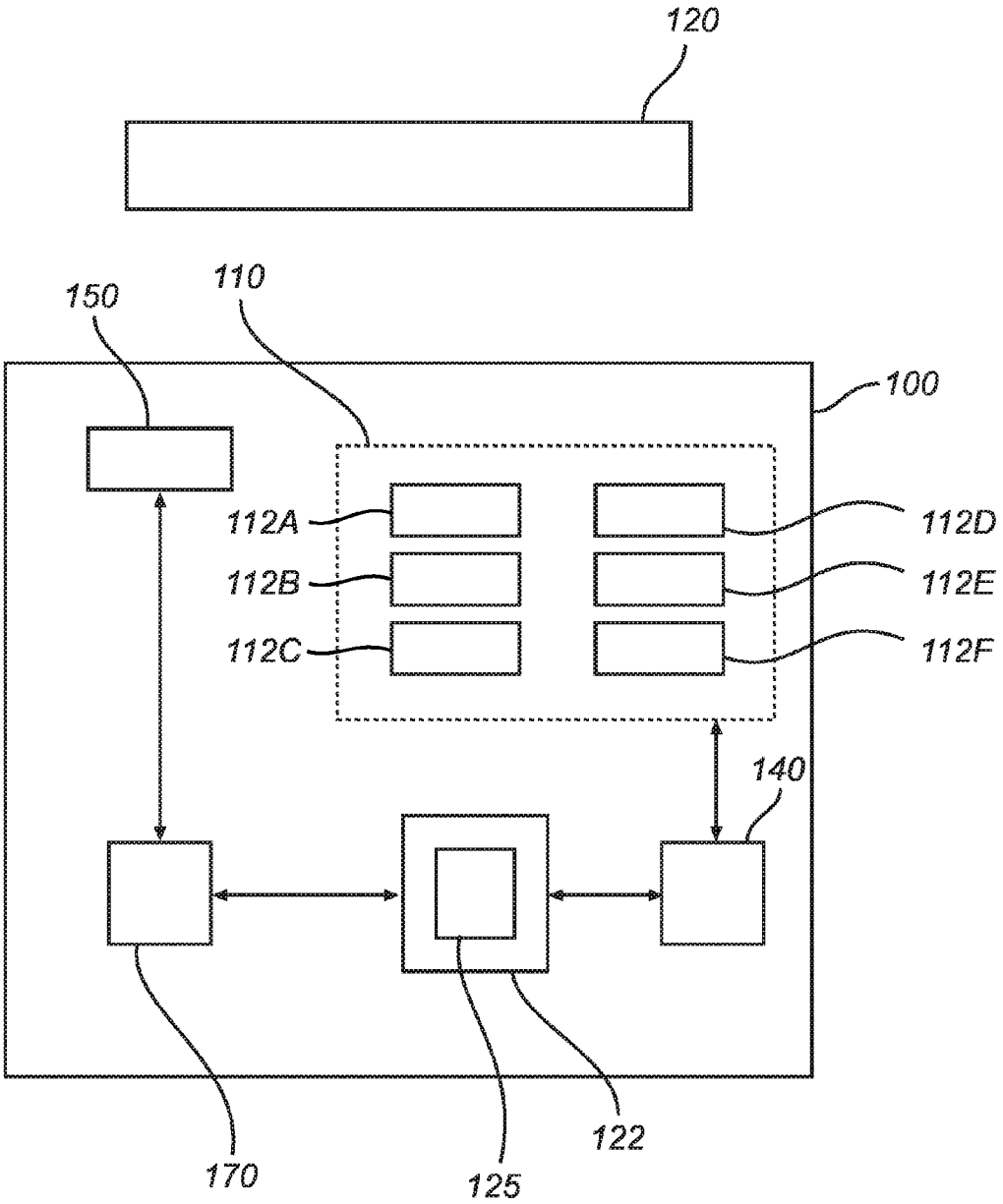
FIG. 1B is a schematic block diagram of a light-emitting device according to another exemplifying embodiment of the present invention.

Referring now to FIG. 1B, there is shown a schematic block diagram of a light-emitting device 100 according to another exemplifying embodiment of the present invention. The light-emitting device 100 comprises a plurality 110 of light sources 112A, 112B, . . . , 112F for illuminating a target 120. The light-emitting device 100 comprises a photo detector module 122 that comprises at least one photo detector 125 adapted to receive light reflected at an illuminated region of the target 120. The light-emitting device 100 comprises a processing module 140 adapted to process signals generated by the at least one photo detector 125 such as to determine a dominant color of the illuminated region of the target 120. On basis of the determined dominant color and a criteria of predetermined color characteristics of light emitted by the light-emitting device 100, the processing module 140 is adapted to generate at least one setting of the intensities of the plurality 110 of light sources 112A, 112B, . . . , 112F relatively to each other such that, when the generated at least one setting is applied to the plurality 110 of light sources 112A, 112B, . . . , 112F, light emitted by the light-emitting device 100 is made increasingly compliant or even compliant with the criteria of the predetermined color characteristics.

With further reference to FIG. 1B, the light-emitting device 100 comprises a light-emitting pointing device 150. At least a portion of the light reflected at an illuminated region of the target 120 received by the at least one photo detector 125 may have been emitted by the light-emitting pointing device 150. The light-emitting device 100 comprises a light modulation unit 170 configured to modulate light emitted by the plurality 110 of light sources 112A, 112B, . . . , 112F, or light emitted by the light-emitting pointing device 150, and detect any modulation of light prior to that light impinging onto the photo detector 125. By the light-emitting pointing device 150 and/or the light modulation unit 170 there may be achieved advantages as discussed in the foregoing.

Both the light-emitting pointing device 150 and the light modulation unit 170 are optional. Furthermore, the light-emitting pointing device 150 and/or the light modulation unit 170 can alternatively be arranged externally in relation to the light-emitting device 100.

The rest of the components disclosed in FIG. 1B are similar or identical to the components described with reference to FIG. 1A. Detailed description thereof with reference to FIG. 1B is therefore omitted.

Figure 2:
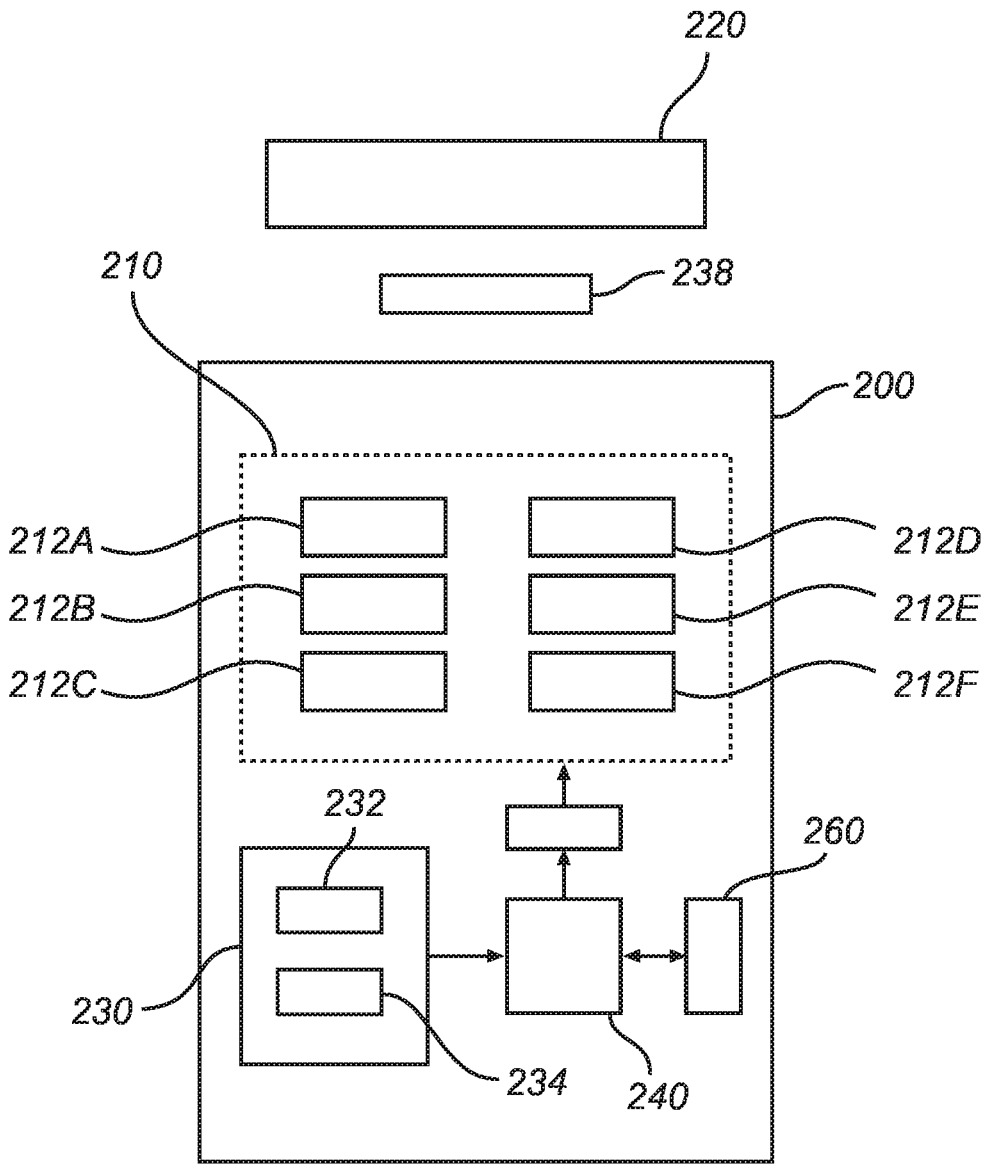
FIG. 2 is a schematic block diagram of a light-emitting device according to another exemplifying embodiment of the present invention.

Referring now to FIG. 2, there is shown a schematic block diagram of a light-emitting device 200 according to another exemplifying embodiment of the present invention. The light-emitting device 200 comprises a plurality 210 of light sources 212A, 212B, . . . , 212F for illuminating a target 220. Each of the light sources 212A, 212B, . . . , 212F is configured to emit light within a predetermined color range. The light-emitting device 200 comprises an image capturing module 230 adapted to capture at least one image comprising an illuminated region of the target 220 and an object 238 having a predetermined shape, the object being disposed between the illuminated region of the target and the light-emitting device such that the object at least partially overlaps the illuminated region in the image. The image capturing module 230 comprises an image sensor 232 adapted to produce an image representation of each captured image. The image sensor 232 may for example comprise a CCD similarly to the image sensor 132 described with reference to FIG. 1A. The light-emitting device 200 further comprises a memory module 260 and a control module 250 (optional). A processing module 240 is adapted to process each image representation such as to compare the predetermined shape of the object 238 with at least one shape stored in the memory module 260. On a condition that the predetermined shape of the object 238 matches a shape stored in the memory module 260, the processing module 240 processes the image representation such as to determine a color of a portion of the illuminated region of the target 220 bordering the object 238 in the image representation. On basis of the determined color and a criteria of a predetermined color characteristics of light emitted by the light-emitting device 200, the processing module 240 is adapted to generate at least one setting of the intensities of the plurality 210 of light sources 212A, 212B, . . . , 212F relatively to each other, the at least one setting configured such that, when applied to the plurality 210 of light sources 212A, 212B, . . . , 212F, light emitted by the light-emitting device 200 is made increasingly compliant or even compliant with the criteria of the predetermined color characteristics. The control module 250 is adapted to apply the generated at least one setting to the plurality 210 of light sources 212A, 212B, . . . , 212F. Alternatively, the processing module 240 itself may be adapted to apply the generated at least one setting to the plurality 210 of light sources 212A, 212B, . . . , 212F (cf. FIG. 1A and the description referring thereto).

As already described in the foregoing with reference to FIG. 1A, the processing module 140 is adapted to process each image representation for the purpose of determining a dominant color in the image representation. The dominant color that is to be determined may be a dominant color of the illuminated region of the target in the image representation.

The dominant color may for example be a color that is the or one of the most abundant in the field of view associated with the image sensor (i.e. a color that is to a larger extent present in the image representation compared to other colors present in the image representation), for example when the light-emitting device is adapted such as to emit substantially white light. Alternatively or optionally, the dominant color may be determined as the average color of the colors appearing in the field of view associated with the image sensor, i.e. the average color of the image representation.

Alternatively or optionally, the dominant color may be determined by a color sequential scan performed by the light-emitting device 100, as described in the following. The processing unit 140 may be configured to control the light sources 112A, 112B, . . . , 112F to emit light for a respective predetermined duration such that light having sequential color with regards to the spectrum of light sequentially impinges on the target 120. The color that exhibits the most intense reflection on the target 120, for example as sensed by the image sensor 132, is taken as the dominant color (either the average reflection of the whole field of view of the image capturing module 130 or the reflection of a selected part of the field of view of the image capturing module 130 is taken into account).

For example, during a sequential scan using three light sources of an RGB arrangement the light sources are controlled to first emit only light of a first color, then only light of a second color and finally light of only a third color. The light sources may be controlled to emit light of further colors.

Alternatively or optionally, a small region of the target may be assigned by the user and the (average) color in that region may subsequently be taken as the dominant color. By a 'small region' it is meant that the region is small compared to the beam of light emitted by the light-emitting device.

The small region may be selected in different manners.

According to one example, in case the image capturing module comprises a single color sensor (e.g. a "single pixel" camera device) as described in the foregoing, the small region may be selected substantially as the field of view of the image capturing module (in this case, the field of view may be relatively small, in general smaller than the region of the target that is illuminated by the light-emitting device).

According to another example, the light-emitting device comprises a user interface (not shown in FIG. 1A) that enables the user to select the desired region in the image. For this purpose the user interface may be adapted to (visually) indicate the image to the user.

With further reference to FIG. 1A and/or FIG. 2, as already described in the foregoing at least one setting of the intensities of the plurality of light sources relatively to each other is generated, the at least one setting being configured such that, when applied to the plurality of light sources, light emitted by the light-emitting device is made increasingly compliant or even compliant with the criteria of the predetermined color characteristics. The at least one setting may for example be generated such that the light emitted by the light-emitting device exhibits a predetermined or user-defined color point and either a maximum contribution of the dominant color or a minimum contribution of the dominant color. For a certain chromaticity (color point) the at least one setting may be generated such that, when applied to the plurality of light sources, the at least one setting results in a spectral power distribution that keeps the CRI at a predetermined value and at the same time results in a relatively large or even maximal saturation of colors for a specific color range.

Figure 3:
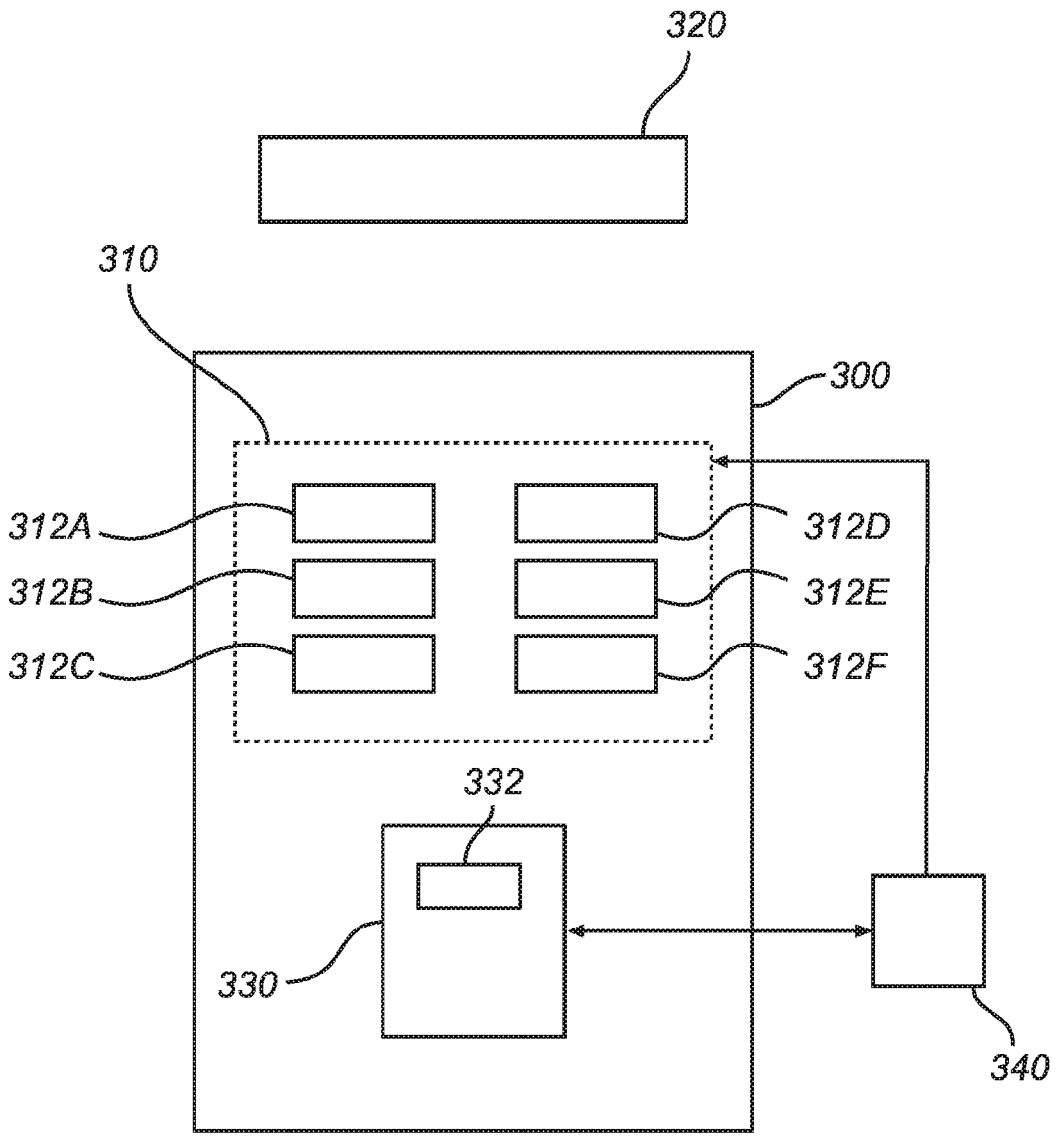
FIG. 3 is a schematic block diagram of a light-emitting device according to another exemplifying embodiment of the present invention.

Referring now to FIG. 3, there is shown a schematic block diagram of a light-emitting device 300 according to another exemplifying embodiment of the present invention. The light-emitting device 300 comprises a plurality 310 of light sources 312A, 312B, . . . , 312F for illuminating a target 320. The light-emitting device 300 comprises an image capturing module 330 adapted to capture at least one image comprising an illuminated region of the target 320. The image capturing module 330 comprises an image sensor 332 adapted to produce an image representation of each captured image. The components disclosed in FIG. 3 are similar or identical to the components described with reference to FIG. 1A. Detailed description thereof with reference to FIG. 3 is therefore omitted. However, in contrast to the light-emitting device 100 described with reference to FIG. 1A, the light-emitting device 300 has no internal processing module, but a processing module 340 is externally located with respect to the light-emitting device 300.

Figure 4A:
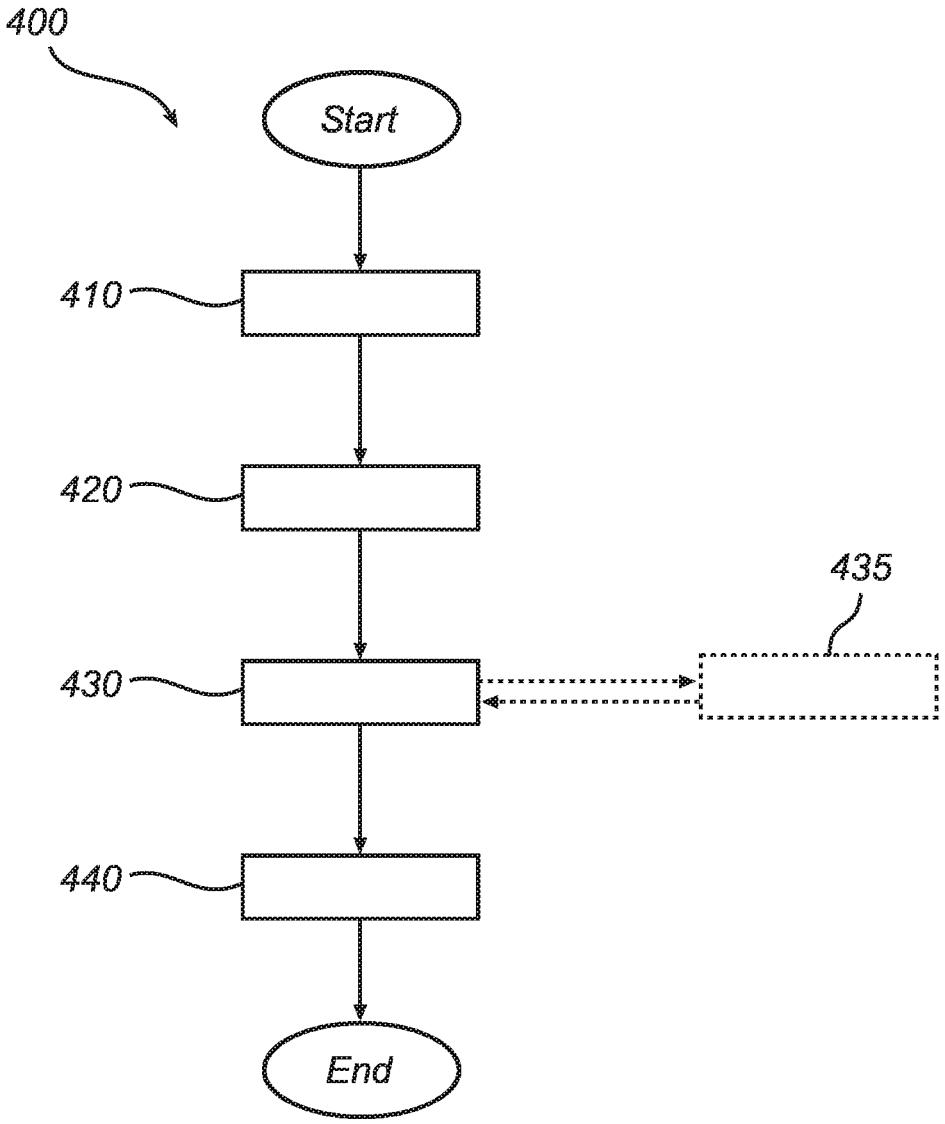
FIG. 4A is a schematic flow diagram of a method of operating a light-emitting device according to an exemplifying embodiment of the present invention.

Referring now to FIG. 4A, there is shown a schematic flow diagram of a method 400 of operating a light-emitting device according to an exemplifying embodiment of the present invention. The light-emitting device comprises a plurality of light sources, each of the light sources being configured to emit light within a predetermined color range.

At step 410, at least one image is captured, the image comprising an illuminated region of the target, and an image representation of each captured image is produced.

At step 420, the image representation is processed such as to determine a dominant color in the image representation.

At step 430, on basis of the dominant color that was determined in step 420 and a criteria of a predetermined color characteristics of light emitted by the light-emitting device, at least one setting for the intensities of the plurality of light sources relatively to each other is generated. The at least one setting is such that, when the at least one setting is applied to the plurality of light sources, light emitted by the light-emitting device is made increasingly compliant or even compliant with the criteria of the predetermined color characteristics.

At step 440, the at least one setting that was generated in step 430 is applied to the plurality of light sources.

Optionally, the step 430 may comprise a step 435 of generating the at least one setting of the intensities of the plurality of light sources relatively to each other under the constraint of keeping the intensity of any light source emitting light within a color range in which the dominant color determined in step 420 is included constant and/or different from zero.

Alternatively or optionally, the step 435 may comprise generating the at least one setting such that the at least one setting, when applied to the plurality of light sources, results in that light emitted from the light-emitting device exhibits the dominant color determined in step 420.

Figure 4B:
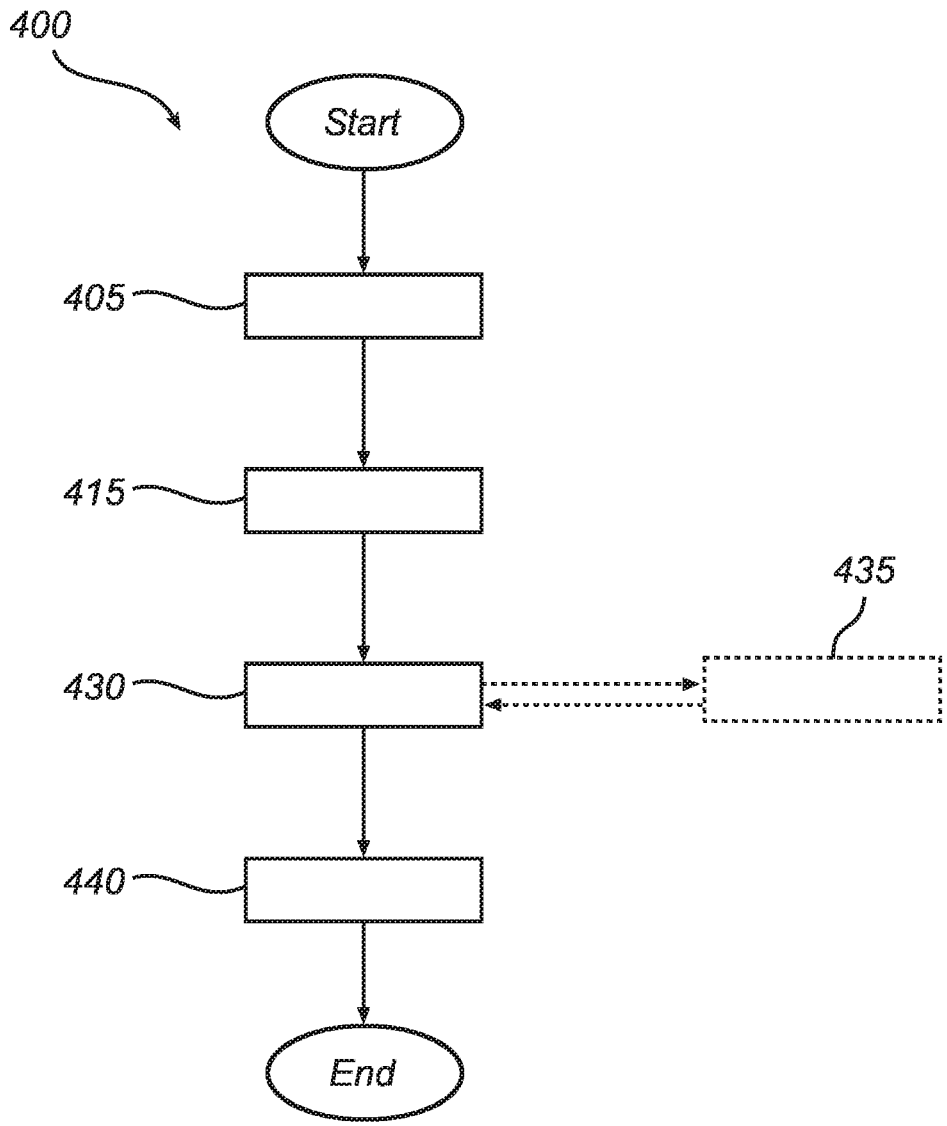
FIG. 4B is a schematic flow diagram of a method of operating a light-emitting device according to another exemplifying embodiment of the present invention.

Referring now to FIG. 4B, there is shown a schematic flow diagram of a method 400 of operating a light-emitting device according to an exemplifying embodiment of the present invention. The light-emitting device comprises a plurality of light sources, each of the light sources being configured to emit light within a predetermined color range.

At step 405, at least one photo detector receives light reflected at an illuminated region of the target.

At step 415, signals generated by the at least one photo detector are processed such as to determine a dominant color of the illuminated region of the target.

At step 430, on basis of the dominant color that was determined in step 415 and a criteria of a predetermined color characteristics of light emitted by the light-emitting device, at least one setting for the intensities of the plurality of light sources relatively to each other is generated. The at least one setting is such that, when the at least one setting is applied to the plurality of light sources, light emitted by the light-emitting device is made increasingly compliant or even compliant with the criteria of the predetermined color characteristics.

At step 440, the at least one setting generated in step 430 is applied to the plurality of light sources.

Optionally, the step 430 may comprise a step 435 of generating the at least one setting of the intensities of the plurality of light sources relatively to each other under the constraint of keeping the intensity of any light source emitting light within a color range in which the dominant color determined in step 415 is included constant and/or different from zero.

Alternatively or optionally, the step 435 may comprise generating the at least one setting such that the at least one setting, when applied to the plurality of light sources, results in that light emitted from the light-emitting device exhibits the dominant color determined in step 415.

Figure 5:
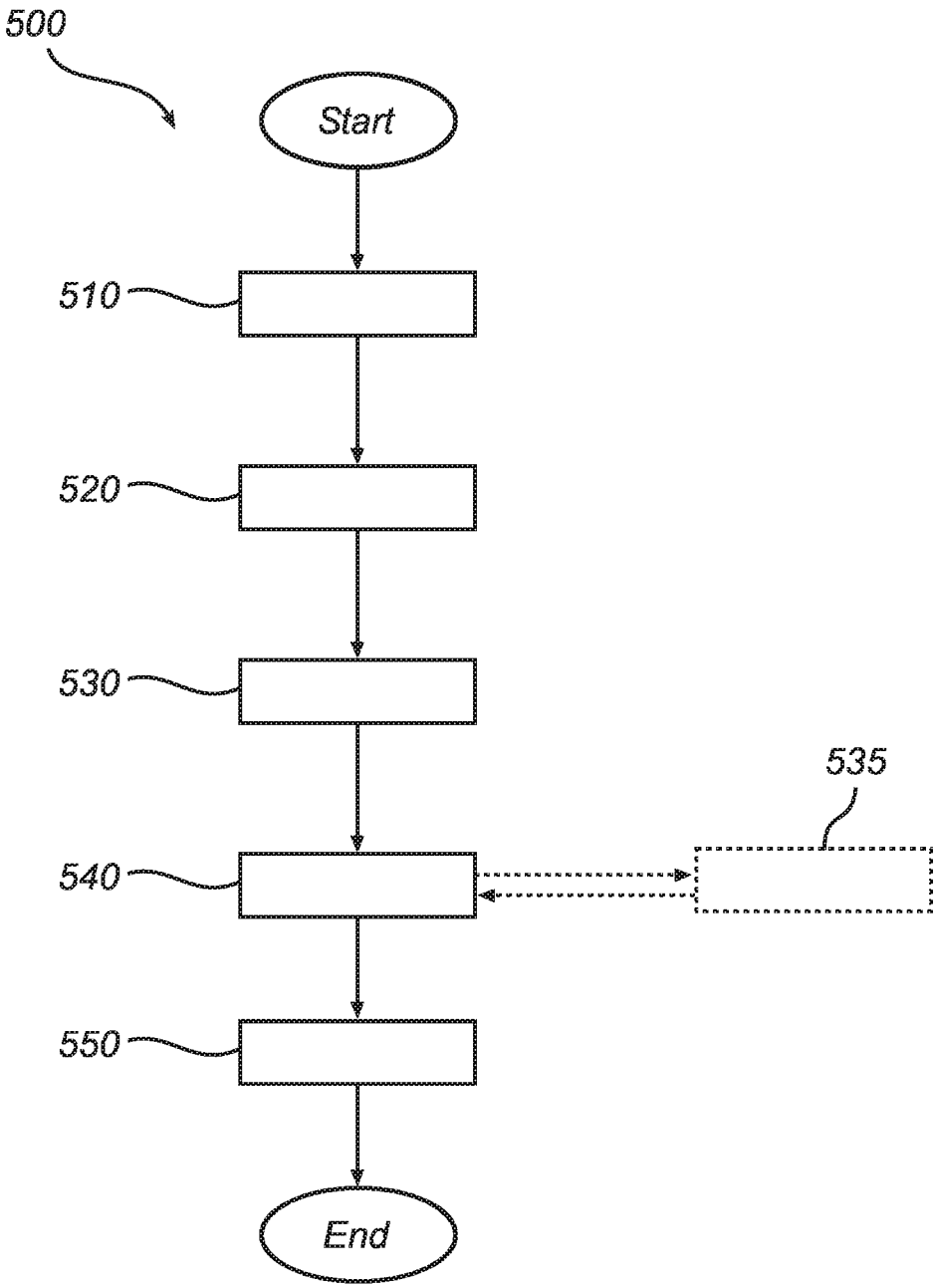
FIG. 5 is a schematic flow diagram of a method of operating a light-emitting device according to another exemplifying embodiment of the present invention.

Referring now to FIG. 5, there is shown a schematic flow diagram of a method 400 of operating a light-emitting device according to another exemplifying embodiment of the present invention. The light-emitting device comprises a plurality of light sources, each of the light sources being configured to emit light within a predetermined color range.

At step 510, at least one image is captured, the image comprising an illuminated region of the target and an object having a predetermined shape, the object being disposed between the illuminated region of the target and the light-emitting device such that the object at least partially overlaps the illuminated region in the image. Step 510 comprises producing an image representation of each captured image.

At step 520, the predetermined shape of the object is compared with at least one stored shape.

At step 530, on a condition that the predetermined shape of the object matches a stored shape, the image representation is processed such as to determine a color of a portion of the illuminated region of the target bordering the object in the image representation.

At step 540, on basis of the color that was determined in step 530 and a criteria of a predetermined color characteristics of light emitted by the light-emitting device, at least one setting for the intensities of the plurality of light sources relatively to each other is generated. The at least one setting is such that, when the at least one setting is applied to the plurality of light sources, light emitted by the light-emitting device is made increasingly compliant or even compliant with the criteria of the predetermined color characteristics.

At step 550, the at least one setting that was generated in step 540 is applied to the plurality of light sources.

Optionally, the step 540 may comprise a step 545 of generating the at least one setting of the intensities of the plurality of light sources relatively to each other under the constraint of keeping the intensity of any light source emitting light within a color range in which the color determined in step 530 is included constant and/or different from zero.

Alternatively or optionally, the step 545 may comprise generating the at least one setting such that the at least one setting, when applied to the plurality of light sources, results in that light emitted from the light-emitting device exhibits the color determined in step 530.

Figure 6:
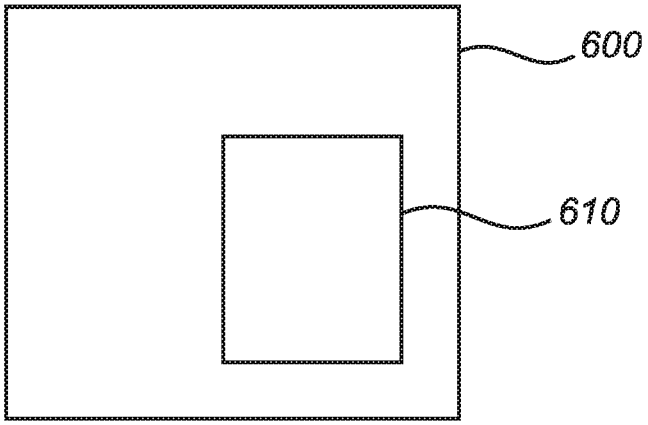
FIG. 6 is a schematic block diagram of a luminaire according to an exemplifying embodiment of the present invention.

Referring now to FIG. 6, there is shown a schematic block diagram of a luminaire 600 according to an exemplifying embodiment of the present invention. The luminaire 600 comprises a light-emitting device 610 according to an embodiment of the present invention.

Figure 7:
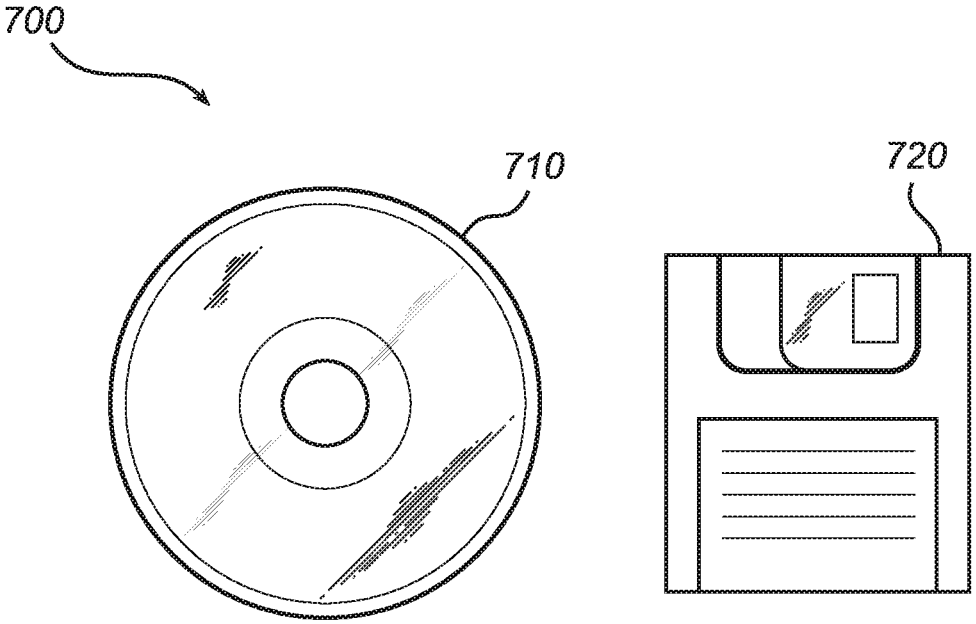
FIG. 7 is a schematic view of different exemplifying types of computer readable storage mediums according to embodiments of the present invention.

Referring now to FIG. 7, there is shown a schematic view of different exemplifying types of computer readable (digital) storage mediums 700 according to embodiments of the present invention, comprising a Digital Versatile Disc (DVD) 710 and a floppy disk 720. On each of the DVD 710 and the floppy disk 720 there may be stored a computer program comprising computer code adapted to perform, when executed in a processor unit, a method according to the present invention or any embodiment thereof, as has been described in the foregoing.

Although only two different types of computer-readable digital storage mediums have been described above with reference to FIG. 7, the present invention encompasses embodiments employing any other suitable type of computer-readable digital storage medium, such as, but not limited to, a hard disk drive, a Compact Disc, a flash memory, magnetic tape, a Universal Serial Bus stick, a Zip drive, etc.

In conclusion, light-emitting devices and methods for operating light-emitting devices are disclosed. Each of the light-emitting devices comprises a plurality of light sources for illuminating a target, wherein each of the light sources is configured to emit light within a predetermined color range. Each of the light-emitting devices comprises means for automatically adjusting the spectral power distribution of light emitted by the light-emitting device on basis of the color of the target or a region of the target illuminated by the light-emitting device, such that light emitted by the light-emitting device is made increasingly compliant or even compliant with a criteria of a predetermined color characteristics.

Although exemplary embodiments of the present invention have been described herein, it should be apparent to those having ordinary skill in the art that a number of changes, modifications or alterations to the invention as described herein may be made. Thus, the above description of the various embodiments of the present invention and the accompanying drawings are to be regarded as non-limiting examples of the invention and the scope of protection is defined by the appended claims. Any reference signs in the claims should not be construed as limiting the scope.

The invention claimed is:

1. A light-emitting device comprising a plurality of light sources for illuminating a target, each of the light sources being configured to emit light within a predetermined color range, the light-emitting device further comprising:

at least one photo detector adapted to receive light reflected at an illuminated region of the target; and a processing module adapted to process signals generated by said at least one photo detector such as to produce an image representation of the illuminated region, said image representation being comprised of a plurality of colors, and to determine a dominant color of the illuminated region of the target by calculating which color of the image representation is one of:

a most abundant color, wherein the most abundant color is the color most present in the plurality of colors;

an average color, wherein the average color is calculated by averaging the plurality of colors; or a most intense color, wherein the most intense color represents the color of the most intense reflected light received by the at least one photo detector;

and, on basis of the dominant color and a criteria of predetermined color characteristics of light emitted by the light-emitting device, generate at least one setting of the intensities of the plurality of light sources relatively to each other such that, when said at least one setting is applied to the plurality of light sources, light emitted by the light-emitting device is made compliant with said criteria of the predetermined color characteristics.

2. A light-emitting device according to claim 1, further comprising an image capturing module being arranged with the at least one photo detector, which image capturing module is adapted to capture at least one image comprising an illuminated region of the target, the image sensor being adapted to produce an image representation of each captured image, and wherein the processing module is adapted to process said image representation such as to determine a dominant color of the illuminated region of the target in said image representation.

3. A light-emitting device according to claim 1, wherein the processing module is further adapted to generate the at least one setting of the intensities of the plurality of light sources relatively to each other under the constraint of keeping the intensity of any light source emitting light within a color range in which the determined dominant color is included constant and/or different from zero.

4. A light-emitting device according to claim 3, wherein the processing module is further adapted to generate the at least one setting such that said at least one setting, when applied to the plurality of light sources, results in that light emitted from the light-emitting device exhibits the determined dominant color.

5. A light-emitting device according to claim 1, further comprising at least one light-emitting pointing device (150), wherein at least a portion of the light reflected at an illuminated region of the target received by the at least one photo detector has been emitted by the light-emitting pointing device.

6. A light-emitting device according to claim 5, further comprising a light modulation unit (170) configured to modulate light emitted by the plurality of light sources, or light emitted by the light-emitting pointing device, and detect modulation of light impinging onto the at least one photo detector.

7. A light-emitting device comprising a plurality of light sources for illuminating a target, each of the light sources being configured to emit light within a predetermined color range, the light-emitting device further comprising:

an image capturing module adapted to capture at least one image comprising an illuminated region of the target and an object having a predetermined shape, the image capturing module comprising an image sensor adapted to produce an image representation of each captured image, the object being disposed between the illuminated region of the target and the light-emitting device such that the object at least partially overlaps the illuminated region in the image;

a memory module, storing at least one shape; and a processing module adapted to:

process said image representation such as to compare the predetermined shape of the object with the at least one shape stored in the memory module;

on a condition that the predetermined shape matches a shape stored in the memory module, further process said image representation such as to determine a color of a portion of the illuminated region of the target bordering said object in the image representation; and on basis of the determined color and a criteria of a predetermined color characteristics of light emitted by the light-emitting device, generate at least one setting of the intensities of the plurality of light sources relatively to each other such that, when said at least one setting is applied to the plurality of light sources, light emitted by the light-emitting device is made compliant with said criteria of the predetermined color characteristics.

8. A light-emitting device according to claim 7, wherein the processing module is further adapted to generate the at least one setting of the intensities of the plurality of light sources relatively to each other under the constraint of keeping the intensities of the respective light sources emitting light within a color range in which the determined color is included constant and/or different from zero.

9. A light-emitting device according to claim 8, wherein the processing module is further adapted to generate the at least one setting such that said at least one setting, when applied to the plurality of light sources, results in that light emitted from the light-emitting device exhibits the determined color.

10. A light-emitting device according to claim 1, wherein the predetermined color characteristics comprises one or more of color rendering of the light-emitting device, chromaticity of the color of emitted light and color temperature of the color of emitted light.

11. A light-emitting device according to claim 1, further comprising a control module adapted to apply the generated at least one setting to the plurality of light sources.

12. A method of operating a light-emitting device comprising a plurality of light sources, each of the light sources being configured to emit light within a predetermined color range, wherein:

at least one photo detector receiving light reflected at an illuminated region of the target; the method comprising:

processing signals generated by said at least one photo detector such as to produce an image representation of the illuminated region, said image representation being comprised of a plurality of colors, and to determine a dominant color of the illuminated region of the target by calculating which color of the image representation is one of:

a most abundant color, wherein the most abundant color is the color most present in the plurality of colors;

an average color, wherein the average color is calculated by averaging the plurality of colors; or a most intense color, wherein the most intense color represents the color of the most intense reflected light received by the at least one photo detector;

and, on basis of the dominant color and a criteria of a predetermined color characteristics of light emitted by the light-emitting device, generating at least one setting for the intensities of the plurality of light sources relatively to each other such that, when said at least one setting is applied to the plurality of light sources, light emitted by the light-emitting device is made compliant with said criteria of the predetermined color characteristics; and applying the generated at least one setting to the plurality of light sources.

13. A method of operating a light-emitting device comprising a plurality of light sources, each of the light sources being configured to emit light within a predetermined color range, the method comprising:

capturing at least one image comprising an illuminated region of the target and an object having a predetermined shape, the object being disposed between the illuminated region of the target and the light-emitting device such that the object at least partially overlaps the illuminated region in the image, and producing an image representation of each captured image;

comparing the predetermined shape of the object with at least one shape stored in a memory module;

on a condition that the predetermined shape matches the stored shape, processing said image representation such as to determine a color of a portion of the illuminated region of the target bordering said object in the image representation;

on basis of the determined color and a criteria of a predetermined color characteristics of light emitted by the light-emitting device, generating at least one setting for the intensities of the plurality of light sources relatively to each other such that, when said at least one setting is applied to the plurality of light sources, light emitted by the light-emitting device is made compliant with said criteria of the predetermined color characteristics; and applying the generated at least one setting to the plurality of light sources.

14. A non-transitory computer-readable storage medium on which there is stored a computer program product adapted to, when executed in a processor unit, perform a method according to claim 12.

15. A luminaire comprising a light-emitting device according to claim 1.

* * * * *